US012604977B2

(12) United States Patent
Chen

(10) Patent No.: US 12,604,977 B2
(45) Date of Patent: Apr. 21, 2026

(54) STORAGE SHELF FOR TOOL-FREE CABINET ASSEMBLY

(71) Applicant: Protrend Co., Ltd., Taipei City (TW)

(72) Inventor: Shun-Yi Chen, Taipei City (TW)

(73) Assignee: PROTREND CO., LTD., Taipei City (TW)

( * ) Notice: Subject to any disclaimer, the term of this patent is extended or adjusted under 35 U.S.C. 154(b) by 230 days.

(21) Appl. No.: 18/619,210

(22) Filed: Mar. 28, 2024

(65) Prior Publication Data

US 2025/0213033 A1 Jul. 3, 2025

(30) Foreign Application Priority Data

Dec. 28, 2023 (TW) ..... 112151205

(51) Int. Cl.
*A47B 47/00* (2006.01)

(52) U.S. Cl.
CPC ..... *A47B 47/0083* (2013.01)

(58) Field of Classification Search
CPC ... A47B 47/03; A47B 47/042; A47B 47/0075; A47B 47/0083
See application file for complete search history.

(56) References Cited

U.S. PATENT DOCUMENTS

| | | | | |
|---|---|---|---|---|
| 4,195,890 | A * | 4/1980 | Kellogg | A47B 47/0083 312/265.2 |
| 6,193,340 | B1 * | 2/2001 | Schenker | A47B 47/0075 312/265.5 |
| 12,185,834 | B1 * | 1/2025 | Chen | A47B 57/402 |
| 2007/0080614 | A1 * | 4/2007 | Stein | A47B 47/042 312/107 |
| 2020/0069049 | A1 * | 3/2020 | Derelöv | A47B 47/042 |
| 2022/0378197 | A1 * | 12/2022 | Chen | A47B 57/545 |
| 2024/0148136 | A1 * | 5/2024 | DeSmet | A47B 47/042 |

* cited by examiner

*Primary Examiner* — Matthew W Ing
(74) *Attorney, Agent, or Firm* — WPAT, PC

(57) ABSTRACT

A storage shelf for tool-free cabinet assembly includes column set, rung assembly, horizontal laminate, vertical laminate and assembly device. The column set includes square pipe elements. The rung assembly is provided between these square pipe elements, one horizontal laminate is used as a top plate, and another one a bottom plate provided on the rung assembly. The vertical laminate is provided between the top and bottom plates. The assembly device includes first and second assembly components. The first assembly component is connected to the horizontal laminate, the second assembly component vertical laminate. The first assembly component includes elastic buckle element. The second assembly component includes curved concave buckle element buckled with elastic buckle element, so as to assemble the vertical laminate between the top and bottom plates.

9 Claims, 17 Drawing Sheets

STORAGE SHELF FOR TOOL-FREE CABINET ASSEMBLY

CROSS REFERENCE TO RELATED APPLICATION

All related applications are incorporated by reference. The present application is based on, and claims priority from, Taiwan Application Serial Number 112151205, filed on Dec. 28, 2023, the disclosure of which is hereby incorporated by reference herein in its entirety.

TECHNICAL FIELD

The pressure disclosure relates to a storage shelf, and more particularly to a storage shelf for tool-free cabinet assembly.

BACKGROUND

Combined storage shelfs can be randomly combined according to the needs of the occasion, and are suitable for home interiors, offices, etc. The columns of the combined storage shelf can be divided into round pipe and square pipe column types. If round pipe columns are used, their shape and structure cannot be assembled laterally and horizontally, which is not conducive to expanding the assembly space. Therefore, in order to expand the assembly space, square pipe columns are used.

However, the storage shelf that is customarily assembled with square tube columns are often fixed with rivets or screws, which is inconvenient to assemble, troublesome to disassemble, and reduces usability.

In addition, the cabinets in the storage shelf are usually fixed on the storage shelf with a combination device and a tool. This not only causes holes on the side surface of the cabinet, but also some products use plastic assemblies. Special tools are required in processing and production, and the production requirements are high, and the product defect rate is also high.

Therefore, how to overcome the problems encountered by conventional storage shelfs will be one of the issues to be solved by the industry.

SUMMARY

The present disclosure proposes a storage shelf for tool-free cabinet assembly, having a simple structure, capable of stably assembling a cabinet or a storage shelf without tools, being strongly stable in assembly, and easy to disassemble.

In an embodiment, the present disclosure proposes A storage shelf for tool-free cabinet assembly, including: a column set, including a plurality of square pipe elements; at least one rung assembly, provided between the square pipe elements; at least two horizontal laminates, wherein one of the at least two horizontal laminates is a top plate, another one of the two horizontal laminates is a bottom plate, and the horizontal laminate used as the bottom plate is provided on the rung assembly; at least two vertical laminates, provided between the horizontal laminate used as the top plate and the horizontal laminate used as the bottom plate; and a plurality of assembly devices, respectively including a first assembly component and a second assembly component, wherein each of the first assembly components is connected to the horizontal laminate corresponding thereto, each of the second assembly components is connected to the vertical laminates corresponding thereto, each of the first assembly component includes a first main body and an elastic buckle element, one end of each of the elastic buckle elements is rotatably connected to a bottom side of the first main body corresponding thereto, each of the second assembly components includes a second main body, an extending protrusion element and a curved concave buckle element, each of the extending protrusion element is connected to one side of the second main body corresponding thereto, each of the curved concave buckle elements is provided inside the extending protrusion element corresponding thereto, each of the curved concave buckle elements and the elastic buckle element corresponding thereto are buckled to each other, so as to assemble each of the vertical laminates between the horizontal laminate used as the top plate and the horizontal laminate used as the bottom plate corresponding thereto.

In an embodiment, the above storage shelf for tool-free cabinet assembly further includes: at least one rear plate element, wherein each of the horizontal laminates includes a first horizontal surface and a second horizontal surface opposite to each other, and a backplate groove, each of the backplate grooves is recessed in the second horizontal surface corresponding thereto, each of the vertical laminates includes a first vertical surface and a second vertical surface opposite to each other, and a side plate groove, each of the side plate grooves is recessed in the second vertical surface corresponding thereto, two opposite sides of each of the rear plate elements are inserted in the side plate groove in the vertical laminate corresponding thereto, and one bottom side of each of the rear plate element is inserted in the backplate groove in the horizontal laminate corresponding thereto.

In an embodiment of the present disclosure, each of the first assembly components further includes a screw hole, a columnar boss element, and a screw, each of the horizontal laminates includes a plurality of side surfaces, a horizontal laminate screw hole and a horizontal laminate positioning hole, the side surfaces are connected between the first horizontal surface and the second horizontal surface, each of the screw holes and each of the positioning holes are respectively penetrated in the side surface corresponding thereto, each of the columnar boss elements is inserted in the horizontal laminate positioning hole corresponding thereto, each of the screws is passed through the screw hole and the horizontal laminate screw hole in sequence.

In an embodiment of the present disclosure, each of the first assembly components further includes a protruding extension element, each of the protruding extension elements is a protruding structure protrudingly provided on a surface of the first main body corresponding thereto, each of the protruding extension elements has an accommodation groove, each of the screw holes is penetrated in the protruding extension element corresponding thereto, and one side of each of the screw holes is positioned inside the accommodation groove corresponding thereto, each of the columnar boss elements is protrudingly provided on the accommodation groove corresponding thereto, and one side of each of the columnar boss elements is projected out of the first main body to the outside.

In an embodiment of the present disclosure, each of the columnar boss elements is a non-cylinder.

In an embodiment of the present disclosure, each of the second assembly component further includes a screw hole, a columnar boss element, and a screw, each of the screw holes is penetrated in the second main body corresponding thereto, each of the columnar boss elements is protrudingly provided on the second main body corresponding thereto, each of the vertical laminates includes a first vertical surface and a second vertical surface opposite to each other, a vertical laminate screw hole, and a vertical laminate positioning hole, each of the vertical laminate positioning holes and each of the vertical laminate screw holes are penetrated in different positions of the first vertical surface corresponding thereto, each of the columnar boss elements is inserted in the vertical laminate positioning hole corresponding thereto, and each of the screws is passed through the screw hole and the vertical laminate screw hole in sequence.

In an embodiment of the present disclosure, each of the columnar boss elements is a non-cylinder.

In an embodiment of the present disclosure, each of the square pipe elements includes a plurality of assembly holes, the rung assembly includes a plurality of buckle elements, each of the buckle elements is buckled inside the assembly hole corresponding thereto.

In an embodiment of the present disclosure, arrangement directions of the vertical laminates are perpendicular to arrangement directions of the horizontal laminates.

Based on the above, the cabinet of the storage shelf for tool-free cabinet assembly of the present disclosure is assembled, no tool needs to be used. The first assembly component on the horizontal laminate is used to rest and act on the square pipe element, and the interaction force between the first assembly component and the second assembly component between the horizontal laminate and the vertical laminate can stably assemble a cabinet or a storage shelf for tool-free cabinet assembly.

In order to make the above-mentioned features and advantages of the present disclosure more obvious and easier to understand, embodiments are cited below and described in detail with reference to the attached drawings.

DETAILED DESCRIPTION

The following embodiments are enumerated and described in detail with reference to the accompanying drawings, but the provided embodiments are not intended to limit the scope of the present disclosure. In addition, the drawings are for illustrative purposes only and are not drawn to original size. To facilitate understanding, the same elements will be identified with the same symbols in the following description.

The terms "including", "comprising", "having", etc. mentioned in the present disclosure are all open terms, that is, they mean "comprising but not limited to".

In the description of each embodiment, when terms such as "first", "second", "third", "fourth", etc. are used to describe elements, they are only used to distinguish these elements from each other, and there is no restriction on the order or importance of these elements.

In the description of various embodiments, the so-called "coupling" or "connection" may refer to two or more components making direct physical or electrical contact with each other, or indirectly making physical or electrical contact with each other. "Coupling" or "connection" can also refer to the mutual operation or action of two or more components.

Figure 1:
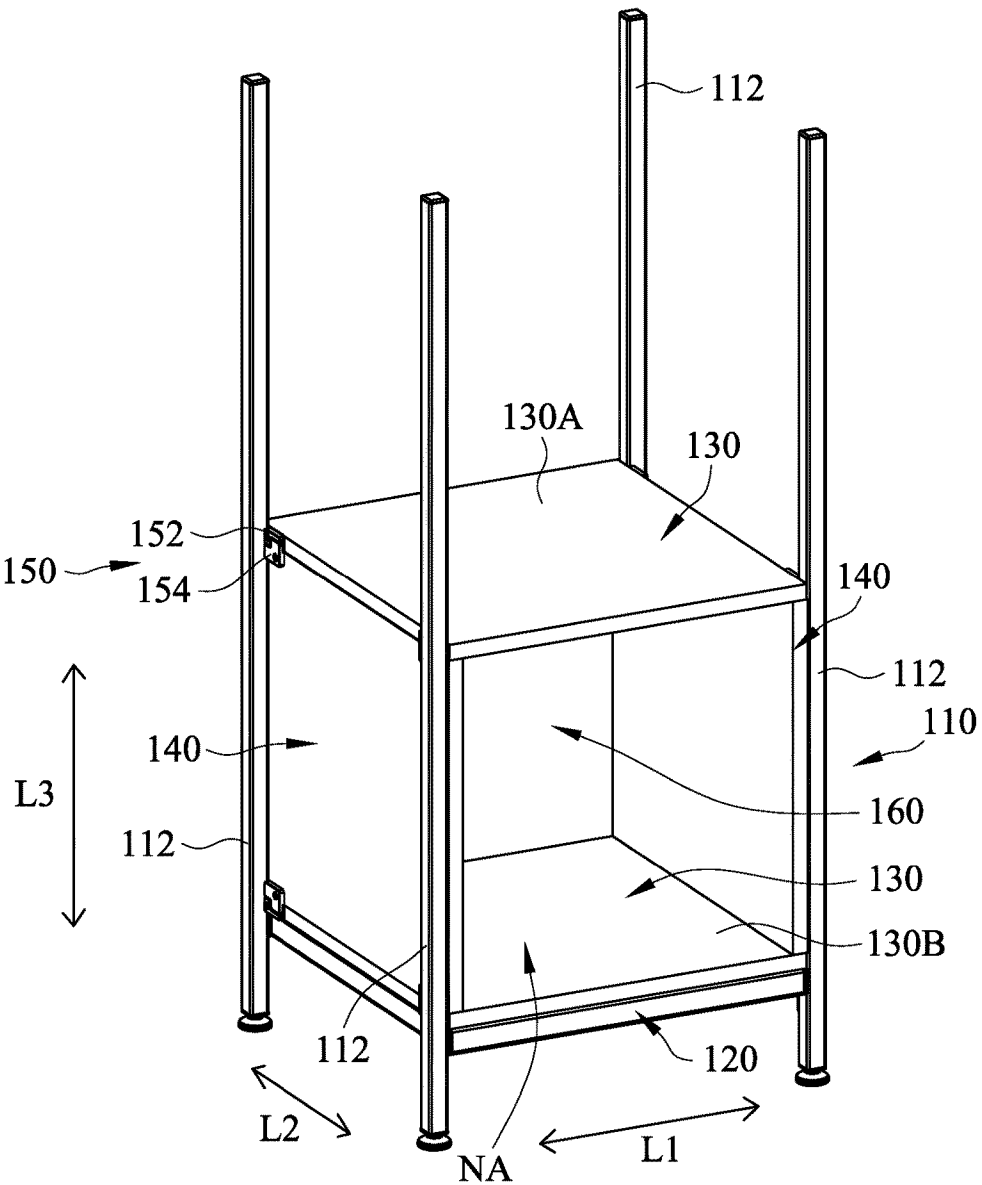
FIG. 1 is a perspective view of an embodiment of a storage shelf for tool-free cabinet assembly according to the present disclosure.
Figure 2:
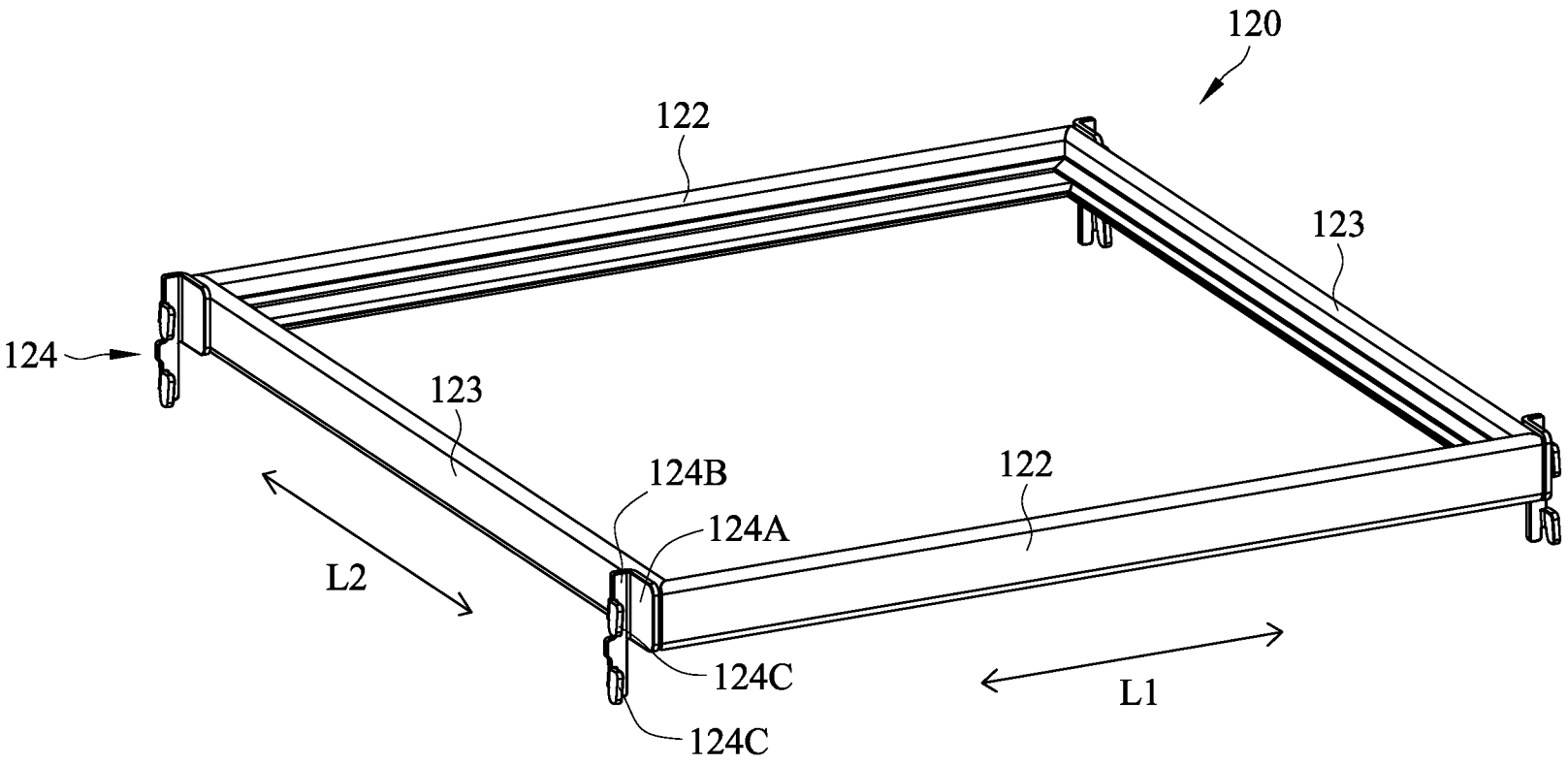
FIG. 2 is a perspective view of a rung assembly of FIG. 1 according to the present disclosure.
Figure 3B:
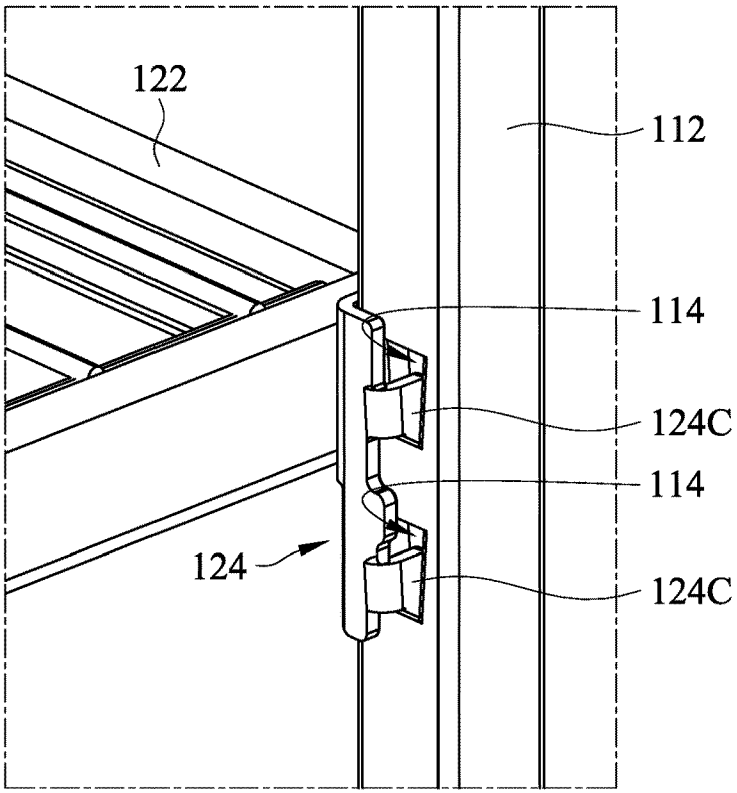
FIG. 3B is a schematic view of a horizontal laminate of the present disclosure from an angle of view.
Figure 3A:
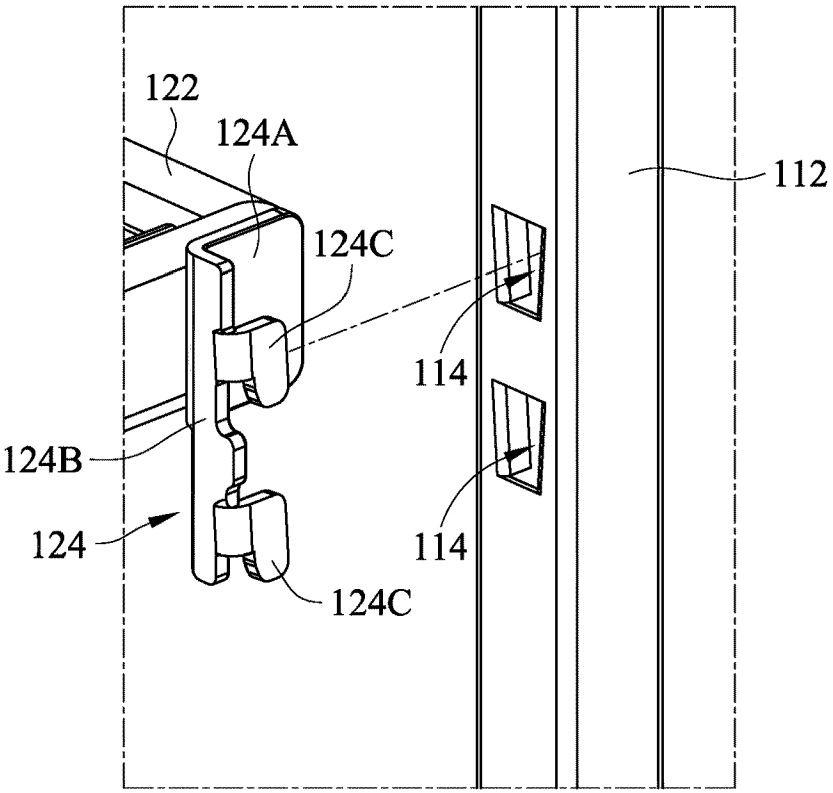
FIG. 3A is a schematic view of a rung assembly assembled to a square pipe element according to the present disclosure.

FIG. 1 is a perspective view of an embodiment of a storage shelf for tool-free cabinet assembly. FIG. 2 is a perspective view of a rung assembly of FIG. 1 according to the present disclosure. FIG. 3A is a schematic view of a rung component and a square pipe element according to the present disclosure before assembly. FIG. 3B is a schematic view of a rung component assembled with a square pipe element according to the present disclosure. Referring to FIGS. 1 to 3B, a storage shelf 100 for tool-free cabinet assembly according to the present disclosure includes a column set 110, at least one rung assembly 120, at least one horizontal laminate 130, at least one vertical laminate 140, an assembly device 150, and a rear panel 160.

The column set 110 includes four square pipe elements 112, where the square pipe element 112 is constituted by four plate elements to form a hollow rectangular body, and is for example an iron pipe. The two square pipe elements 112 spaced apart a distance are arranged along a first direction L1, and the other two square pipe elements spaced apart a distance are arranged along a second direction L2.

One surface of the square pipe element 112 is provided with an assembly hole 114 (as shown in FIGS. 3A and 3B) having a shape that is wide at the top and narrow at the bottom.

The rung assembly 120 is provided between these square pipe elements 112, and includes two first plate elements 122, two second plate elements 123 and four buckling structures 124, where the two first plate elements 122 are spaced apart a distance along the second direction L2 to form the front and rear side structures of the rung assembly 120, and the two second plate elements 123 are spaced apart a distance along the first direction L1 to form the left and right side structures of the rung assembly. Furthermore, the first plate elements 122 are connected to the corresponding second plate elements 123 to form a rectangular body, and each two buckling structures 124 are provided on the second plate elements 123 at the left and right sides of the rung assembly 120, and the buckling structure 124 is respectively positioned on the two opposite sides of the second plate element 123.

The buckling structure 124 includes a fixing element 124A, an extending protrusion element 124B, and a plurality of buckling elements 124C, where the extending protrusion element 124B is vertically connected to the fixing element 124A, allowing an angle to be formed between the extending protrusion element 124B and the fixing element 124A. These buckling elements 124C are vertically connected to the extending protrusion element 124B, also allowing an angle to be formed between the buckling element 124C and the extending protrusion element 124B. The fixing element 124A and these buckling elements 124C are respectively vertically extended out a distance from the two sides of the extending protrusion element 124B, and the extension direction of the fixing element 124A and these buckling elements 124C are the same, and a distance is formed between the fixing element 124A and these buckling elements 124C. The fixing element 124A is connected to the second plate element 123, allowing the buckling structures 124 to be fixed on the outer surface of the second plate element 123.

As shown in FIG. 2, these buckling elements 124C are respectively extended toward a direction, and the two buckling elements 124C in the buckling structure 124 are separated a distance. During assembly, as shown in FIG. 3A, the buckling element 124C is moved toward the assembly hole 114 in the square pipe element 112, allowing the buckling element 124C to be engaged inside the assembly hole 114, so as to assemble the rung assembly 120 to the column set 110, and since the assembly hole 114 is wide at the top and narrow at the bottom, allowing the buckling element 124C to enter from the wider upper side of the assembly hole 114 and drop toward the narrower lower side, allowing the buckling element 124C to be stably engaged inside the assembly hole 114 through the narrower lower hole structure of the assembly hole 114. Vice versa, when detaching, the rung assembly 120 is faced upward, so as to allow the buckling element 124C to be moved toward the upper side of the assembly hole 114. Since the upper side of the assembly hole 114 is a wider hole structure, it is convenient for a user to move the buckling element 124C away from the assembly hole 114.

Referring to FIG. 1 again, the two horizontal laminates 130 are respectively positioned on the different positions of the column set 110 along a third direction L3; one of the two horizontal laminates 130 is used as a top plate 130A, and another one is used as a bottom plate 130B; the horizontal laminate 130 used as the bottom plate 130B is provided on the rung assembly 120. The two vertical laminates 140 are respectively positioned on the different positions of the column set 110 along the first direction L1, the arrangement direction of the vertical laminate 140 is perpendicular to the arrangement direction of the horizontal laminate 130, and between the two horizontal laminates 130 (the top plate 130A and the bottom plate 130B) is provided with the two vertical laminates 140, and the horizontal laminates 130 and the vertical laminates 140 are assembled by the assembly device 150, where the assembly device 150 is, for example, a plastic structure. The assembly device 150 includes a first assembly component 152 and a second assembly component 154, where the first assembly component 142 is connected to the horizontal laminate 130, the second assembly component 154 is connected to the vertical laminate 140, and the first assembly component 152 and the second assembly component 154 are assembled together, allowing the horizontal laminates 130 and the vertical laminates 140 to be assembled together to form a cabinet NA.

Figure 4:
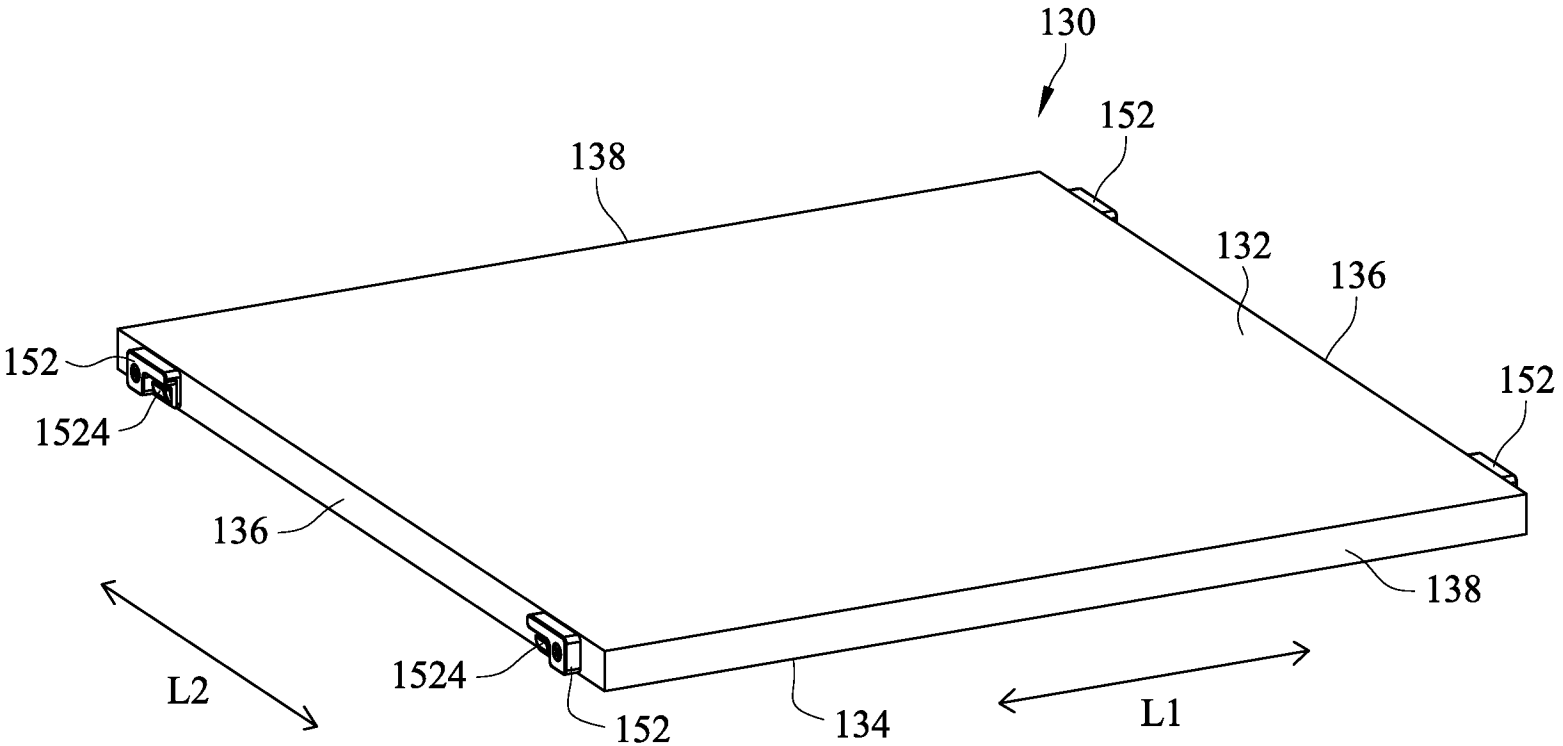
FIG. 4 is a schematic view of a horizontal laminate according to the present disclosure from an angle of view.
Figure 5:
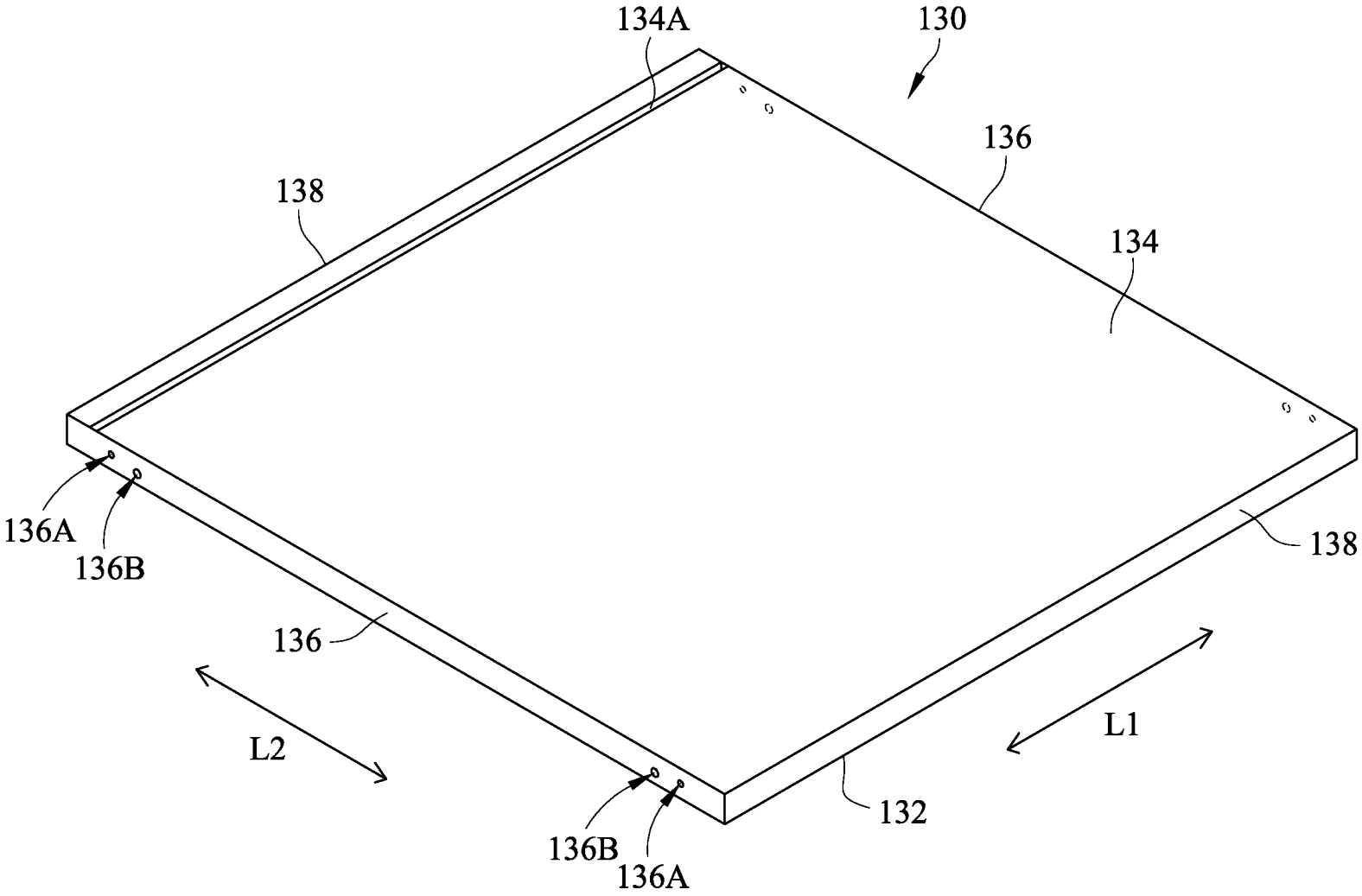
FIG. 5 is a schematic view of a horizontal laminate according to the present disclosure from another angle of view.
Figure 6B:
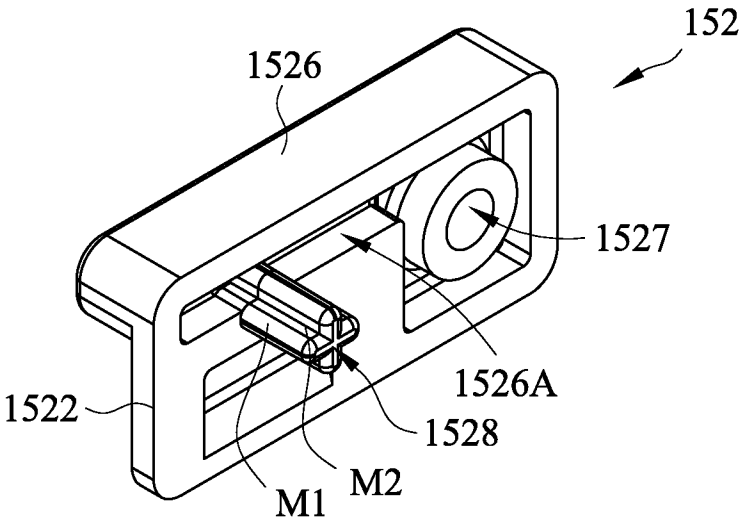
FIGS. 6A to 6C respectively are a schematic view of a first assembly component according to the present disclosure from a different angle of view.
Figure 6A:
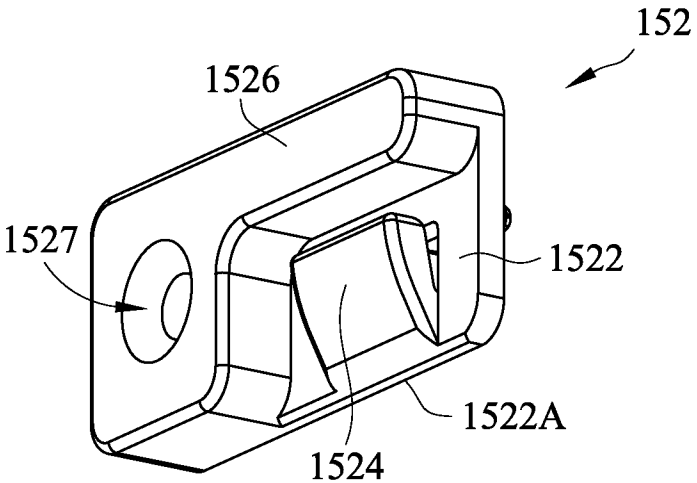
Figure 6C:
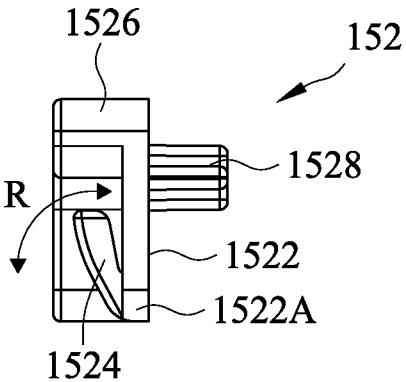
Figure 7B:
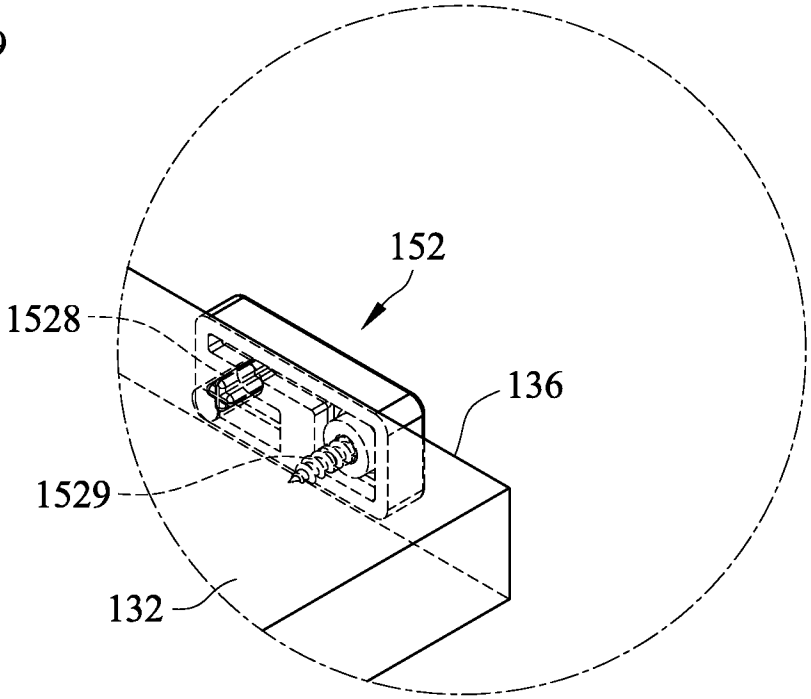
FIGS. 7A and 7B respectively are a schematic view of the assembly process of a first assembly component and a horizontal laminate according to the present disclosure.
Figure 7A:
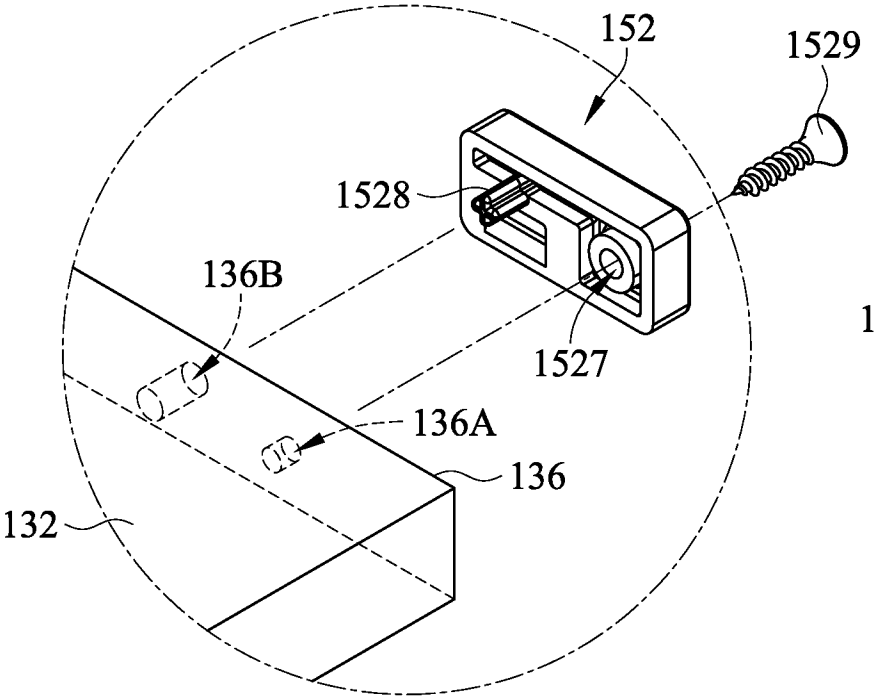

FIG. 4 is a schematic view of a horizontal laminate according to the present disclosure from an angle of view. FIG. 5 is a schematic view of a horizontal laminate according to the present disclosure from another angle of view. FIGS. 6A to 6C respectively are a schematic view of a first assembly component according to the present disclosure from a different angle of view. FIGS. 7A and 7B respectively are a schematic view of the assembly process of a first assembly component and a horizontal laminate according to the present disclosure. Referring to FIGS. 4 to 7B, the horizontal laminate 130 of the present disclosure is a rectangular body, which includes a first horizontal surface 132 and a second horizontal surface 134 opposite to each other, left and right side surfaces 136, front and rear side surfaces 138, where the side surface 136 and the side surface 138 are connected between the first horizontal surface 132 and the second horizontal surface 134, and the first horizontal surface 132 is a flat surface and the second horizontal surface 134 is provided with a backplate groove 134A, which is a groove recessed in the second horizontal surface 134. In addition, the left and right side surfaces 136 are respectively provided with a horizontal laminate screw hole 132A and a horizontal laminate positing hole 136B, where one of the horizontal laminate screw holes 136A and one of the horizontal laminate positioning holes 136B are respectively penetrated in one side of the side surface 136, another horizontal laminate screw hole 136A and another horizontal laminate positioning hole 136B are respectively penetrated in another side of the side surface 136, and compared to the position of the horizontal laminate positioning hole 136B, the two horizontal laminate screw holes 136A are respectively closer to the two end sides of the side surface 136.

The first assembly component 152 includes a first main body 1522, an elastic buckle element 1524, a protruding extension element 1526, a screw hole 1527, a columnar boss element 1528, and a screw 1529 (FIGS. 7A and 7B), where the first main body 1522 is a rectangular body, one end of the elastic buckle element 1524 is rotatably connected to one bottom side 1522A of the first main body 1522 and can tale the bottom side 1522A of the first main body 1522 as an axle center to rotate around a rotating direction R relative to the first main body 1522. The protruding extension element 1526 is a protruding structure protrudingly provided on one surface of the first main body 1522, and the elastic buckle element 1524 is adjacent to the protruding extension element 1526 to cause the protruding structure of the protruding extension element 1526 to be protruded from the elastic buckle element 1524 to ensure that the elastic buckle element 1524 exerts its elastic force without being affected. In an embodiment, the protruding extension element 1526 is provided with an accommodation groove 1526A. The screw hole 1527 is a countersunk screw hole that passes through the protruding extension element 1526, and one side of the screw hole 1527 is positioned inside the accommodation groove 1526A. The columnar boss element 1528 protrudes from the inner surface of the protruding extension element 1526. The columnar boss element 1528 is located in the accommodation groove 1526A, and one side of the columnar boss element 1528 protrudes from the outside of the first main body 1522. The position of the columnar boss element 1528 in the accommodation groove 1526A is different from the position of the screw hole 1527 in the accommodation groove 1526A. The columnar boss element 1528 is a non-cylinder but a unregular structure, for example, as shown in FIG. 6B, the columnar boss element 1528 is constituted by combining four columns M1 together, and there is a depression M2 between the adjacent columns M1.

As shown in FIGS. 7A and 7B, the first assembly component 152 is faced to a side surface 136 of the left, right side of the horizontal laminate 130, the screw hole 1527 is faced to the horizontal laminate screw hole 136A, and the columnar boss element 1528 is faced to the horizontal laminate positioning hole 136B. Next, the columnar boss element 1528 is inserted in the horizontal laminate positioning hole 136B, and the first assembly component 152 is positioned and prevented from rotation through the unregular structure of the columnar boss element 1528. Next, the screw 1529 is passed through the screw hole 1527 and the horizontal laminate screw hole 136A in sequence, allowing the screw 1529 to be locked and attached inside the horizontal laminate screw hole 136A, so as to fix the first assembly component 152 to the side surface 136 of the left, right side of the horizontal laminate 130.

Figure 9:
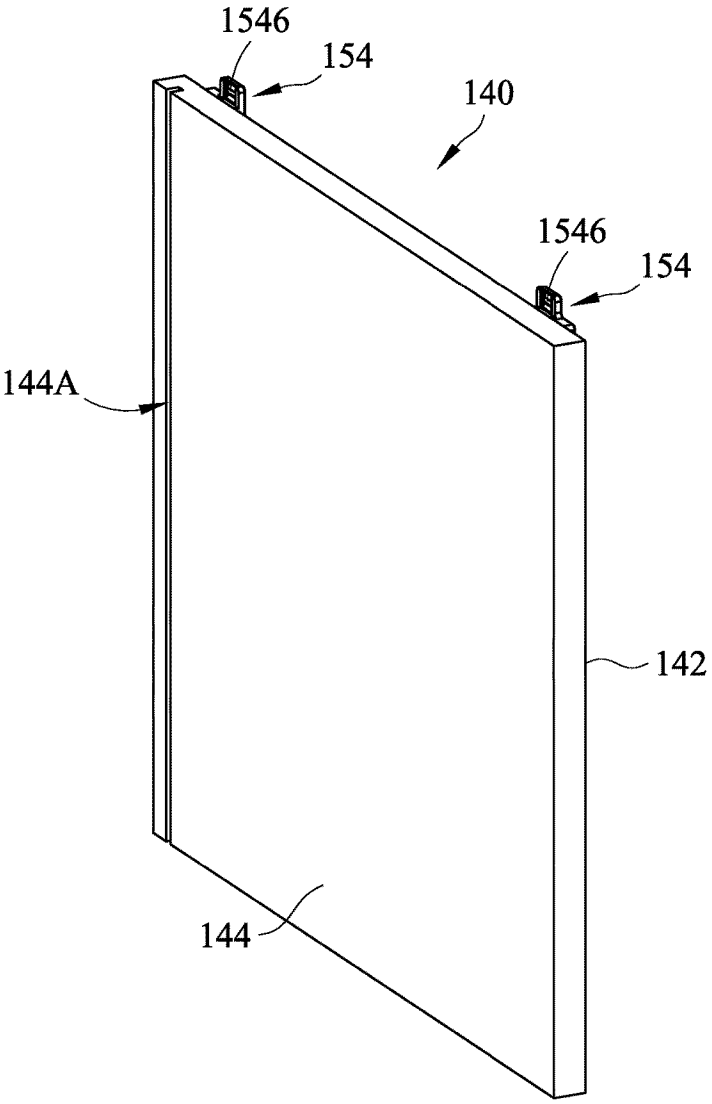
FIG. 9 is a schematic view of a vertical laminate according to the present disclosure from another angle of view.
Figure 8:
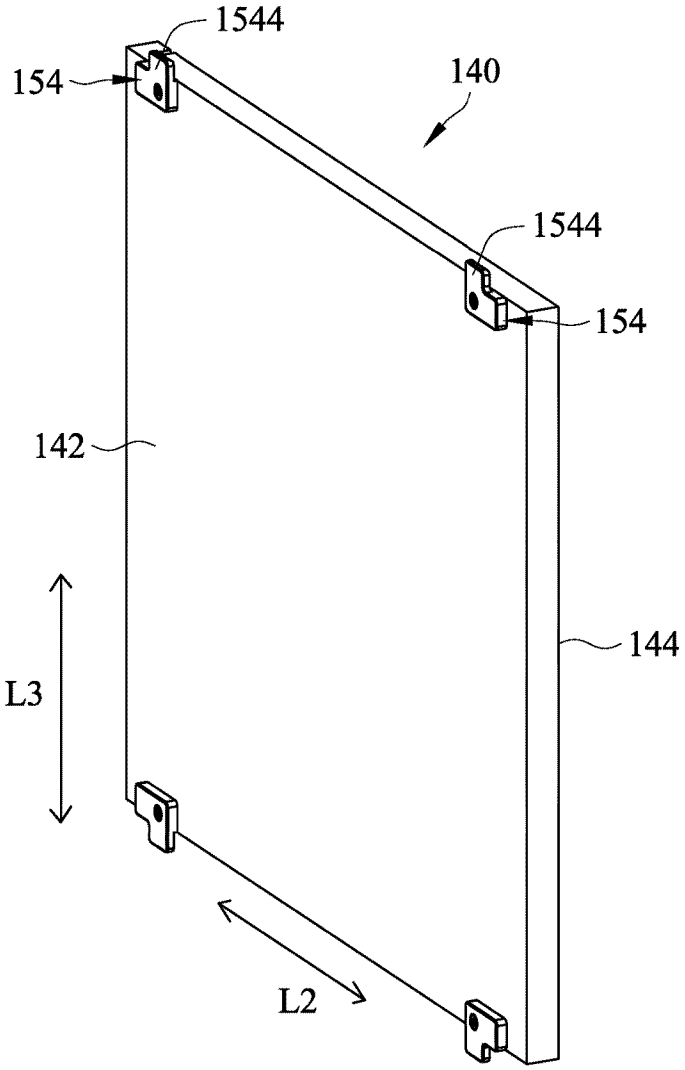
FIG. 8 is a schematic view of a vertical laminate according to the pressure disclosure from an angel of view.
Figure 10B:
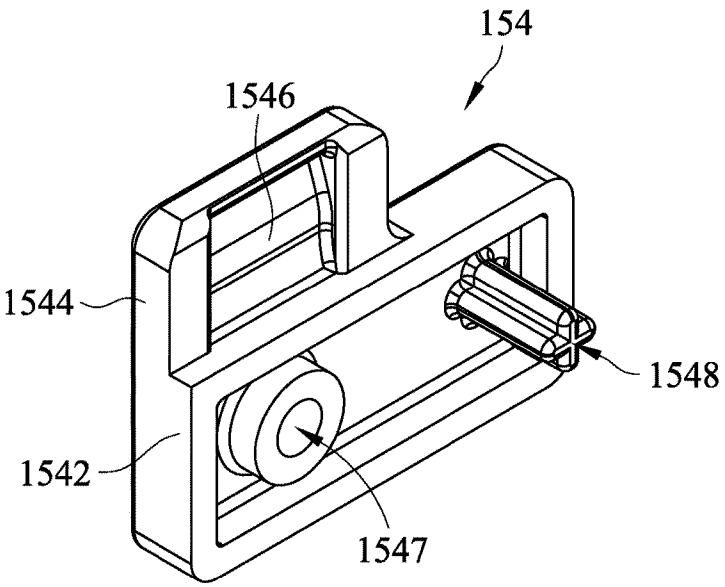
FIGS. 10A to 10C respectively are a schematic view of a second assembly component according to the present disclosure from a different angle of view.
Figure 10C:
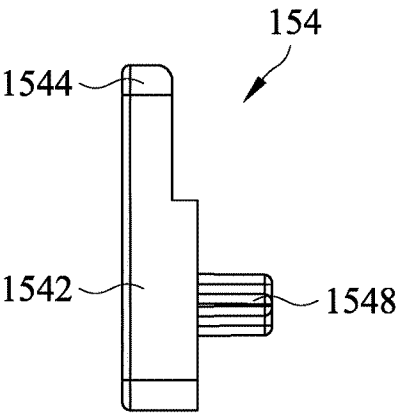
Figure 10A:
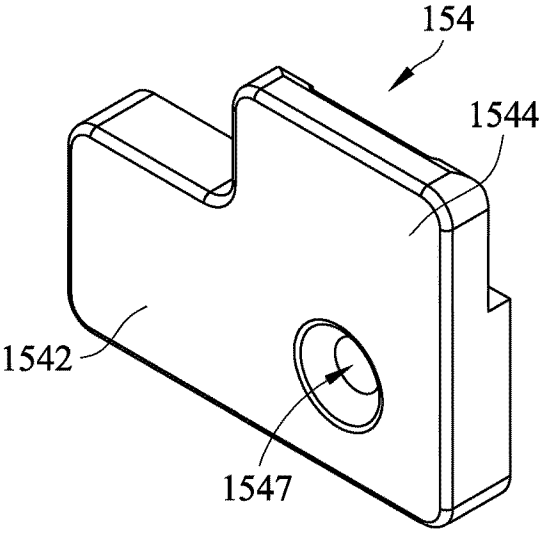
Figure 11B:
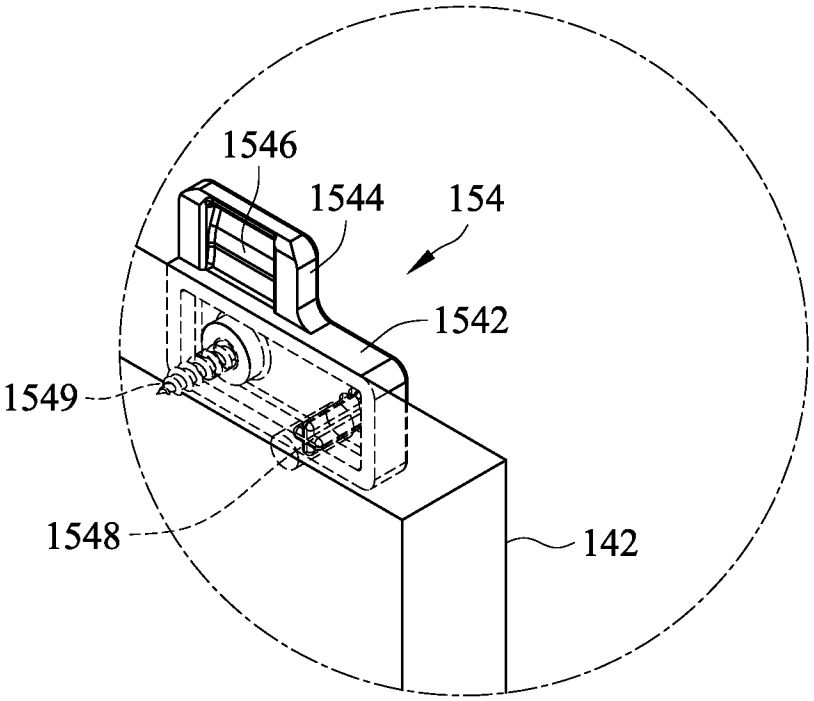
FIGS. 11A and 11B respectively are a schematic view of the assembly process of a second assembly component and a vertical laminate according to the present disclosure.
Figure 11A:
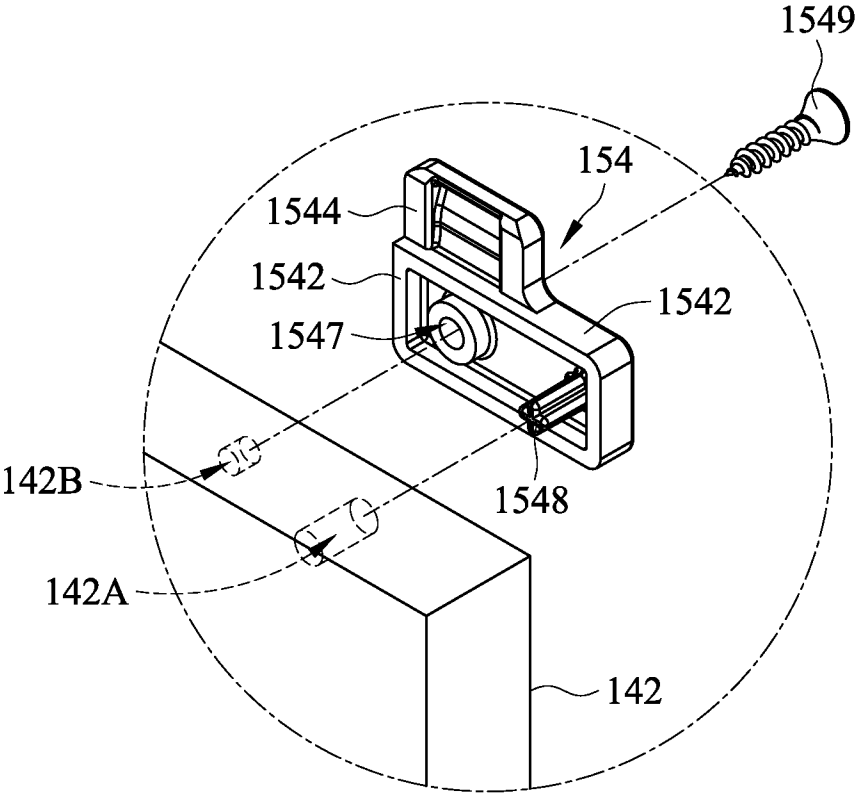

FIG. 8 is a schematic view of a vertical laminate according to the present disclosure from an angle of view. FIG. 9 is a schematic view of a vertical laminate according to the present disclosure from another angle of view. FIGS. 10A to 10C respectively are a schematic view of a second assembly component according to the present disclosure from a different angle of view. FIGS. 11A and 11B respectively are a schematic view of the assembly process of a second assembly component and a vertical laminate according to the present disclosure. Referring to FIGS. 8 to 11B, the vertical laminate 140 of the present disclosure is a rectangular body, which includes a first vertical surface 142 and a second vertical surface 144 opposite to each other, and the first vertical surface 142 is provided with a vertical laminate positioning hole 142A and a vertical laminate screw hole 142B (as shown in FIG. 11A). The vertical laminate positioning hole 142A and the vertical laminate screw hole 142B are respectively penetrated in the different positions of the first vertical surface 142, and the second vertical surface 144 is provided with a side plate groove 144A (as shown in FIG. 9), and the side plate groove 144A is a groove body recessed in the second vertical surface 144.

The second assembly component 154 includes a second main body 1542, an extending protrusion element 1544, a curved concave buckle element 1546, a screw hole 1547, a columnar boss element 1548, and a screw 1549 (FIGS. 11A and 11B), where the second main body 1542 is a rectangular body, and the extending protrusion element 1544 is connected to one side of the second main body 1542, allowing one side of the second main body 1542 to be extended with a protruding structure. The curved concave buckle element 1546 is provided inside the extending protrusion element 1544. The screw hole 1547 is a countersink screw hole penetrated in the second main body 1542. The columnar boss element 1548 is protrudingly provided on the second main body 1542. The position of the columnar boss element is different from the position of the screw hole 1547. The columnar boss element 1548 is a non-cylinder but is a unregular structure. For example, the columnar boss element 1548 may be formed by combining four columns M1 together as shown in FIG. 6B, and there is a recessed body M2 between the adjacent columns M1.

As shown in FIGS. 11A and 11B, the second assembly component 154 is faced to the vertical surface 142 of the vertical laminate 140, and the screw hole 1547 is faced to the vertical laminate screw hole 142B, and the columnar boss element 1548 is faced to the vertical laminate positioning hole 142A. Next, the columnar boss element 1548 is inserted in the vertical laminate positioning hole 142A, and the second assembly component 154 is positioned and prevented from rotation through the unregular structure of the columnar boss element 1548. Next, the screw 1549 is passed through the screw hole 1547 and the vertical laminate screw hole 142B in sequence, allowing the screw 1549 to be locked and attached inside the vertical laminate screw hole 142B so as to fix the second assembly component 154 to the first vertical surface 142 of the vertical laminate 140. Furthermore, as shown in FIGS. 11B, 8 and 9, the extending protrusion element 1544 and the curved concave buckle element 1546 are respectively protruded out of the vertical laminate 140 to the outside.

Figure 12:
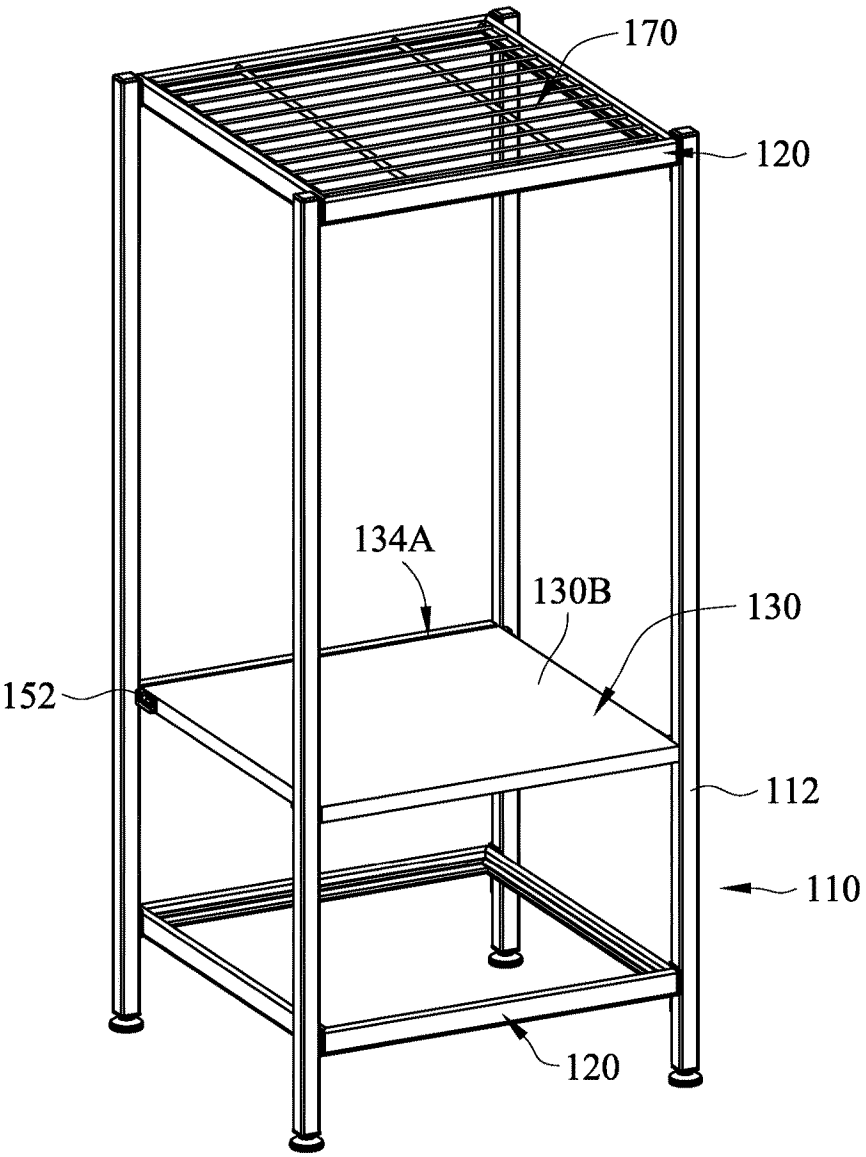
FIG. 12 is a schematic view of an assembly process of a horizontal laminate of a storage shelf for tool-free cabinet assembly according to the present disclosure.

FIG. 12 is a schematic view of an assembly process of a horizontal laminate of a storage shelf for tool-free cabinet assembly according to the present disclosure. Referring to FIG. 12, the rung assembly 120 is provided on the column set 110, and the number of the rung assemblies 120 may be adjusted according to the practical arrangement. As in this embodiment, in addition to one horizontal rung assembly 120 provided below, another horizontal rung assembly 120 is provided above, and the upper rung assembly 120 is provided with a grid 170, which may also be added according to the practical arrangement. The horizontal laminate 130 is dropped from top to bottom onto the rung assembly 120, where the backplate groove 134A is faced upward, and the horizontal laminate 130 may be used as the bottom plate 130B of the cabinet at this time (as shown in FIG. 13).

Figure 13:
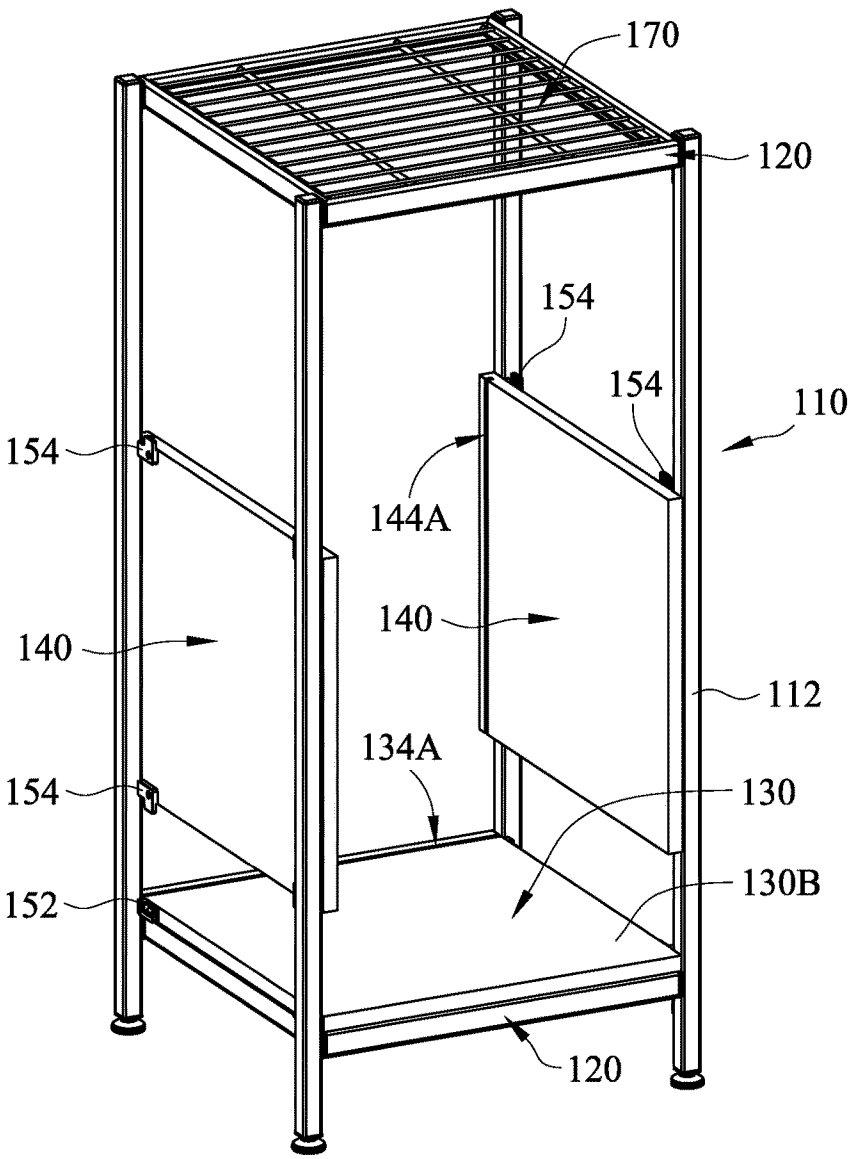
FIG. 13 is a schematic view of an assembly process of a vertical laminate of a storage shelf of a storage shelf for tool-free cabinet assembly according to the present disclosure.
Figure 14C:
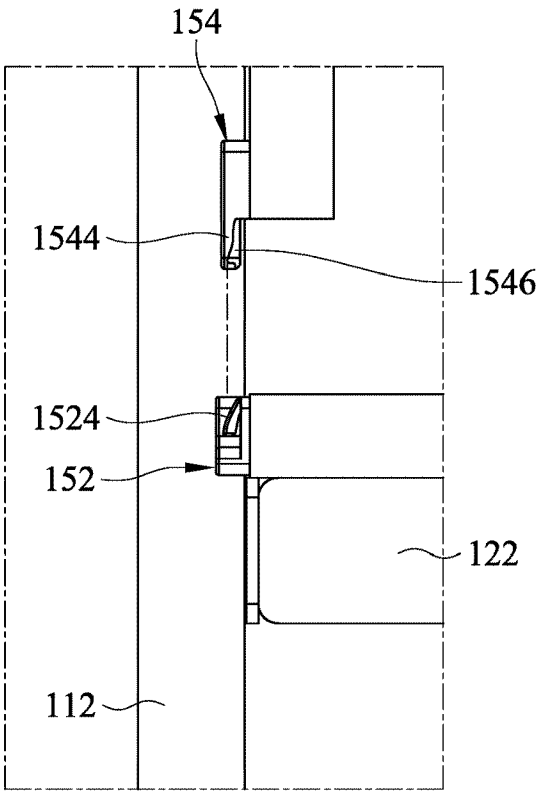
FIGS. 14A to 14C respectively are a schematic view of the assembly process of a first assembly component and a second assembly component according to the present disclosure.
Figure 14B:
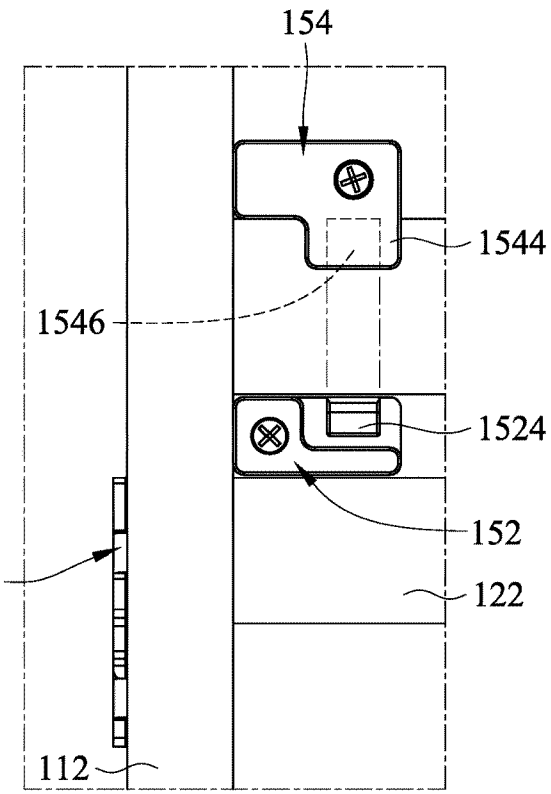
Figure 14A:
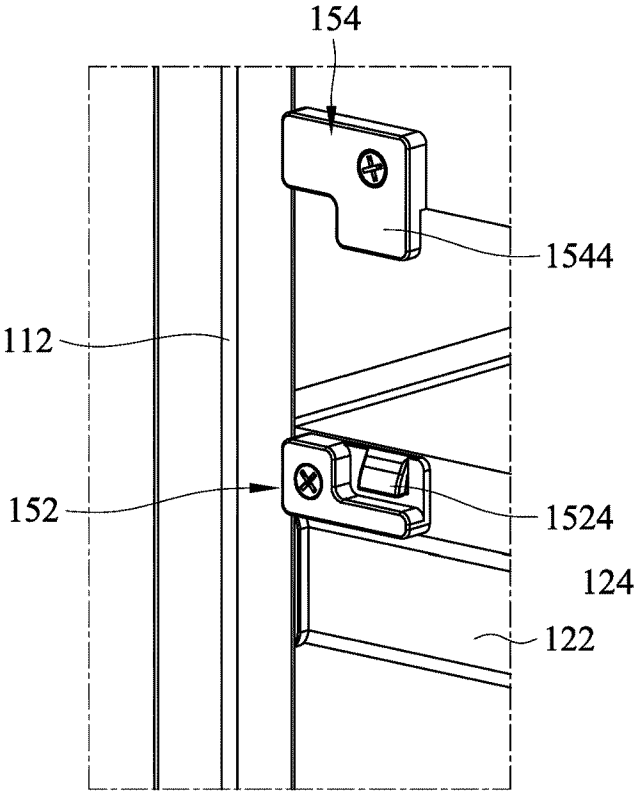
Figure 14E:
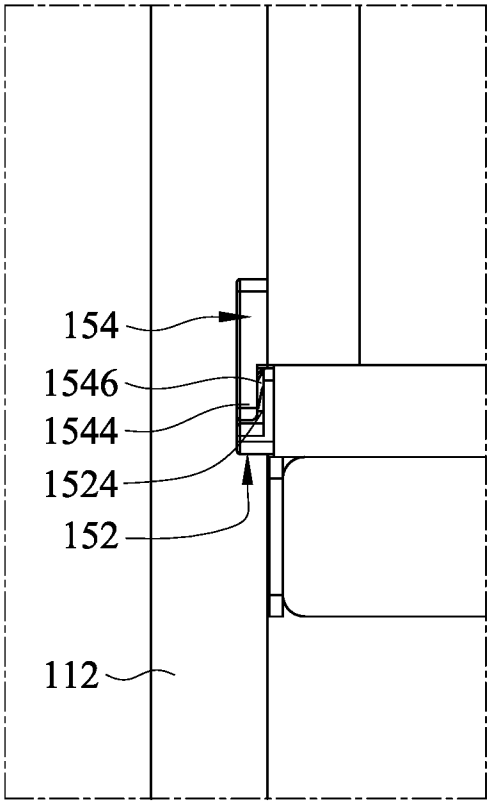
FIGS. 14D and 14E respectively are a schematic view of a first assembly component and a second assembly component according to the present disclosure after assembly.
Figure 14D:
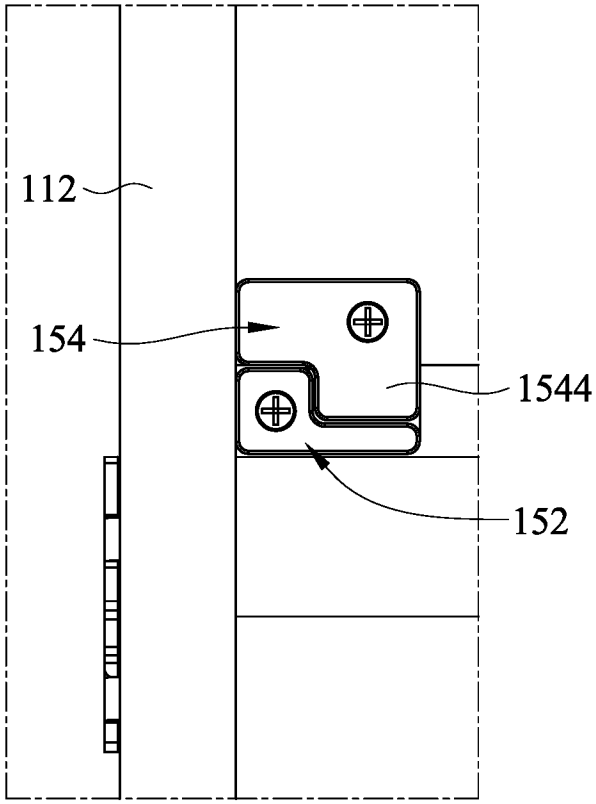

FIG. 13 is a schematic view of an assembly process of a vertical laminate of a storage shelf for tool-free cabinet assembly according to the present disclosure. FIGS. 14A to 14C respectively are a schematic view of an assembly process of a first assembly component and a second assembly component according to the present disclosure from a different angle of view. FIGS. 14D and 14E respectively are a schematic view of a first assembly component and a second assembly component according to the present disclosure after assembly from a different angle of view. Referring to FIGS. 13 to 14E, the horizontal laminate 130 used as the bottom plate 130B is provided on the rung assembly 120, and one side of the first assembly component 152 rests on one surface of the square pipe element 112. Next, the two vertical laminates 140 are respectively erected on the two opposite sides of the horizontal laminate 130 used as the bottom plate 130, and the two vertical laminates 140 are dropped from top to bottom onto the horizontal laminate 130. The second assembly component 154 and the first assembly component 152 are symmetrical to each other, and the curved concave buckle element 1546 in the second assembly component 154 is faced to the elastic buckle element 1524 in the first assembly component 152. When the vertical laminate 140 continues to drop, the curved concave buckle element 1546 is used to buckle together with the elastic buckle element 1524 in the first assembly component 152 and strengthen the supporting structure when matched up with each other, allowing the vertical laminates 140 to be respectively assembled on the horizontal laminate 130.

Figure 15:
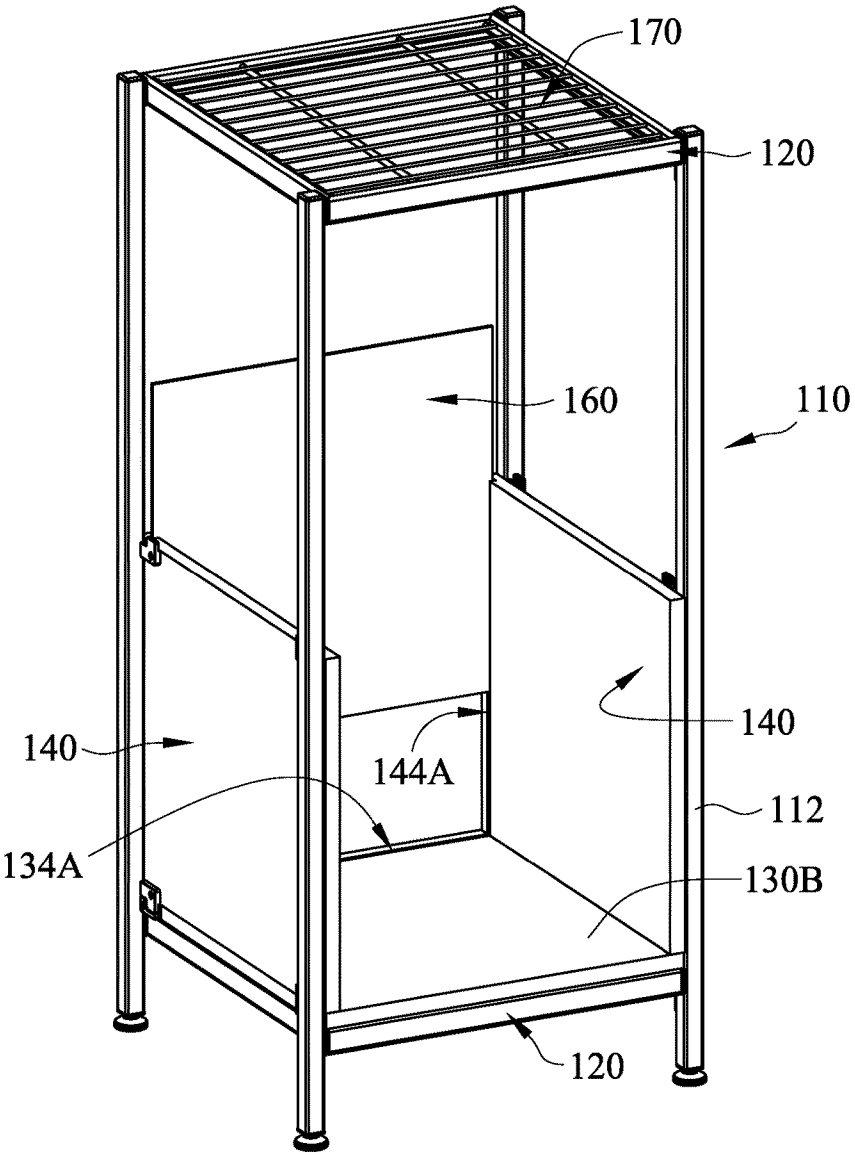
FIG. 15 is a schematic view of an assembly process of a rear plate element according to the present disclosure.

Next, as shown in FIG. 15, a rear plate element 160 is further provided between these two vertical laminates 140, and the two sides of the rear plate element 160 can be inserted in the side plate grooves 144A in the vertical laminates, and the bottom side of the rear plate element 160 can be inserted in the backplate groove 134A in the horizontal laminate 130 used as the bottom plate 130B, so as to assemble the rear plate element 160 between the two vertical laminates 140 to form a structure formed in which the plate elements on the three sides are connected on the bottom plate 130B.

Figure 16:
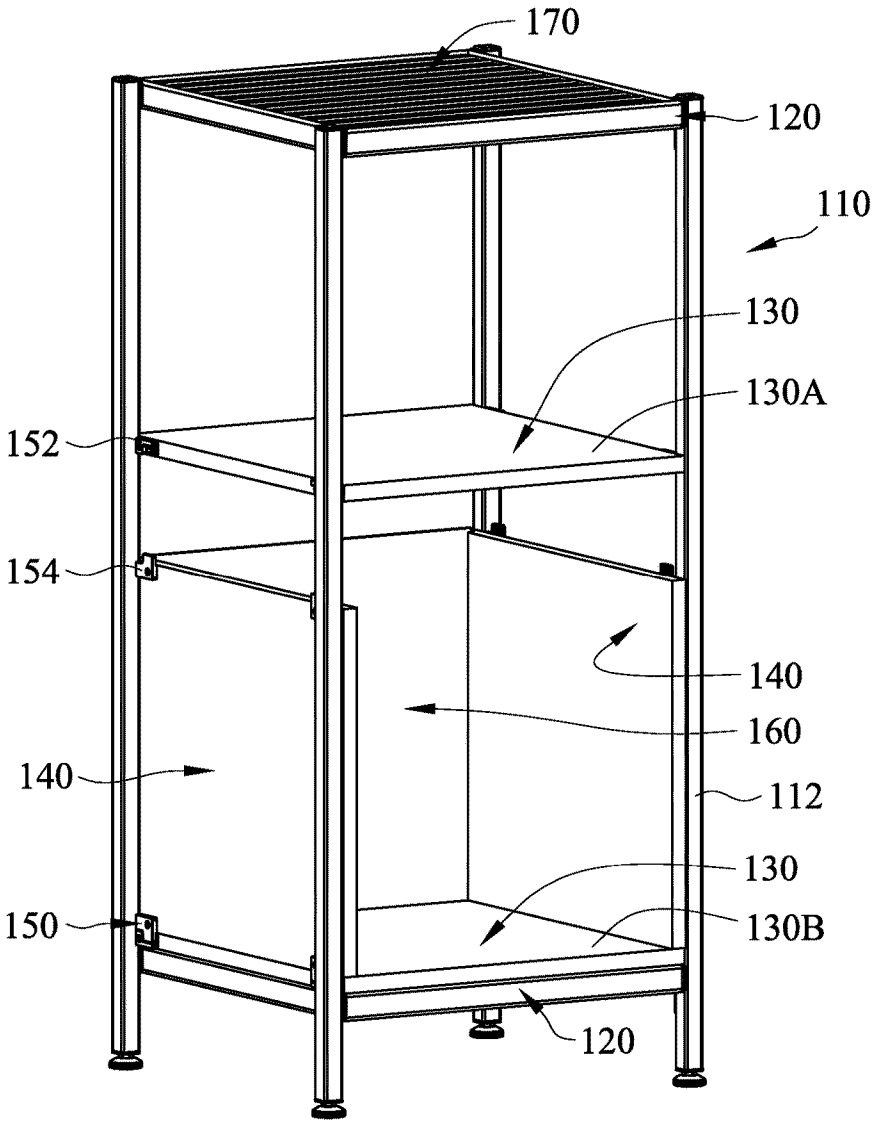
FIG. 16 is a schematic view of an assembly process of a top plate according to the present disclosure.

Next, as shown in FIG. 16, another horizontal laminate 130 is further dropped from top to bottom onto the vertical laminate 140. In the same way, the horizontal laminate 130 is assembled on the vertical laminates 140 by buckling the first assembly element 152 and the second assembly element 154 together, so as to assemble the horizontal laminate 130 on the vertical laminates 140, and this horizontal laminate 130 can be used as the top plate 130A of the cabinet.

Figure 17:
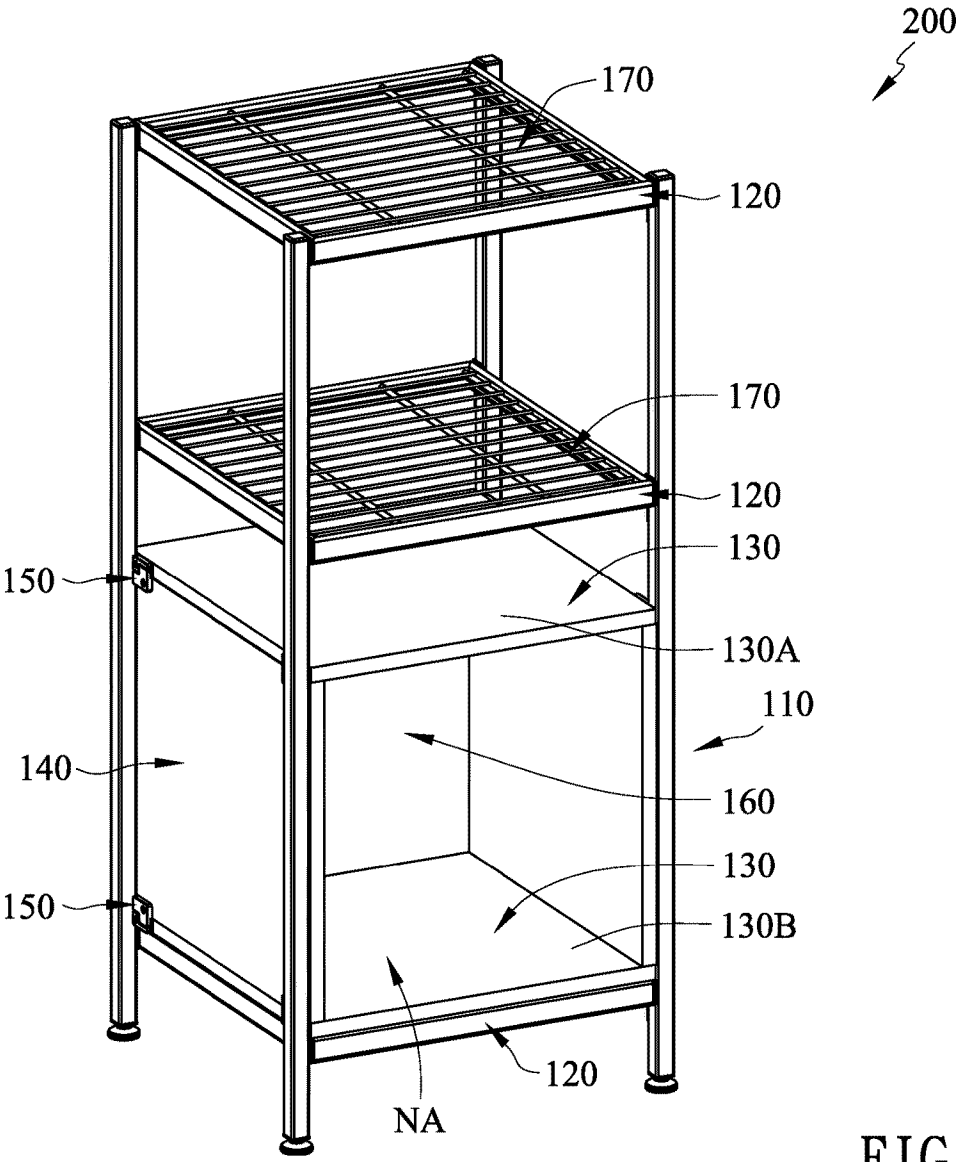
FIG. 17 is a schematic view of another embodiment of a storage shelf for tool-free cabinet assembly according to the present disclosure.

Next, as shown in FIG. 17, the storage shelf 200 for tool-free cabinet assembly may be optionally further provided with a rung assembly 120 and a grid 170. Conclusively, according to the present disclosure, when the cabinet of the storage shelf for tool-free cabinet assembly is assembled, no tool needs to be used. The first assembly component on the horizontal laminate is used to rest and act on the square pipe element, and the interaction force between the first assembly component and the second assembly component between the horizontal laminate and the vertical laminate can stably assemble a cabinet or a storage shelf for tool-free cabinet assembly.

Although the present disclosure has been disclosed as above in the form of embodiments, it is not intended to limit the disclosure. Anyone with ordinary knowledge in the technical field may make some modifications without departing from the spirit and scope of the disclosure, and modifications, so the scope of protection of this disclosure shall be subject to the scope of the patent application attached.

What is claimed is:

1. A storage shelf for tool-free cabinet assembly, comprising:

a column set, comprising a plurality of square pipe elements;

at least one rung assembly, provided between said square pipe elements;

at least two horizontal laminates, wherein one of said at least two horizontal planar members is a top plate, another one of said two horizontal planar members is a bottom plate, and said horizontal planar member used as said bottom plate is provided on said rung assembly;

at least two vertical laminates, provided between said horizontal planar member used as said top plate and said horizontal planar member used as said bottom plate; and a plurality of assembly devices, respectively comprising a first assembly component and a second assembly component, wherein each of said first assembly components is connected to said horizontal planar member corresponding thereto, each of said second assembly components is connected to said vertical planar members corresponding thereto, each of said first assembly component comprises a first main body and an elastic buckle element, one end of each of said elastic buckle elements is rotatably connected to a bottom side of said first main body corresponding thereto, each of said second assembly components comprises a second main body, an extending protrusion element and a curved concave buckle element, each of said extending protrusion element is connected to one side of said second main body corresponding thereto, each of said curved concave buckle elements is provided inside said extending protrusion element corresponding thereto, each of said curved concave buckle elements and said elastic buckle element corresponding thereto are buckled to each other, so as to assemble each of said vertical planar members between said horizontal planar member used as said top plate and said horizontal planar member used as said bottom plate corresponding thereto.

2. The storage shelf according to claim 1, further comprising:

at least one rear plate element, wherein each of said horizontal planar members comprises a first horizontal surface and a second horizontal surface opposite to each other, and a backplate groove, each of said backplate grooves is recessed in said second horizontal surface corresponding thereto, each of said vertical planar members comprises a first vertical surface and a second vertical surface opposite to each other, and a side plate groove, each of said side plate grooves is recessed in said second vertical surface corresponding thereto, two opposite sides of each of said rear plate elements are inserted in said side plate groove in said vertical planar member corresponding thereto, and one bottom side of each of said rear plate element is inserted in said backplate groove in said horizontal planar member corresponding thereto.

3. The storage shelf according to claim 2, wherein each of said first assembly components further comprises a screw hole, a columnar boss element, and a screw, each of said horizontal planar members comprises a plurality of side surfaces, a horizontal planar member screw hole, and a horizontal planar member positioning hole, said side surfaces are connected between said first horizontal surface and said second horizontal surface, each of said screw holes and each of said positioning holes are respectively penetrated in said side surface corresponding thereto, each of said columnar boss elements is inserted in said horizontal planar member positioning hole corresponding thereto, each of said screws is configured to pass through said screw hole and said horizontal planar member screw hole in sequence.

4. The storage shelf according to claim 3, wherein each of said first assembly components further comprises a protruding extension element, each of said protruding extension elements is a protruding structure protrudingly provided on a surface of said first main body corresponding thereto, each of said protruding extension elements has an accommodation groove, each of said screw holes is penetrated in said protruding extension element corresponding thereto, and one side of each of said screw holes is positioned inside said accommodation groove corresponding thereto, each of said columnar boss elements is protrudingly provided on said accommodation groove corresponding thereto, and one side of each of said columnar boss elements is projected out of said first main body to the outside.

5. The storage shelf according to claim 4, wherein each of said columnar boss elements is a non-cylinder.

6. The storage shelf according to claim 1, wherein each of said second assembly component further comprises a screw hole, a columnar boss element, and a screw, each of said screw holes is penetrated in said second main body corresponding thereto, each of said columnar boss elements is protrudingly provided on said second main body corresponding thereto, each of said vertical planar members comprises a first vertical surface and a second vertical surface opposite to each other, a vertical planar member screw hole, and a vertical planar member positioning hole, each of said vertical planar member positioning holes and each of said vertical planar member screw holes are penetrated in different positions of said first vertical surface corresponding thereto, each of said columnar boss elements is inserted in said vertical planar member positioning hole corresponding thereto, and each of said screws is configured to pass through said screw hole and said vertical planar member screw hole in sequence.

7. The storage shelf according to claim 6, wherein each of said columnar boss elements is a non-cylinder.

8. The storage shelf according to claim 1, wherein each of said square pipe elements comprises a plurality of assembly holes, said rung assembly comprises a plurality of buckle elements, each of said buckle elements is buckled inside said assembly hole corresponding thereto.

9. The storage shelf according to claim 1, wherein arrangement directions of said vertical planar members are perpendicular to arrangement directions of said horizontal laminates.

* * * * *